US006644014B2

(12) United States Patent
Provitola

(10) Patent No.: US 6,644,014 B2
(45) Date of Patent: Nov. 11, 2003

(54) ELECTRIC THRUSTER AND THRUST AUGMENTER

(76) Inventor: Anthony Italo Provitola, P.O. Box 2855, DeLand, FL (US) 32721

( * ) Notice: Subject to any disclaimer, the term of this patent is extended or adjusted under 35 U.S.C. 154(b) by 0 days.

(21) Appl. No.: 10/134,216

(22) Filed: Apr. 29, 2002

(65) Prior Publication Data

US 2003/0029159 A1 Feb. 13, 2003

Related U.S. Application Data

(63) Continuation-in-part of application No. 09/676,638, filed on Sep. 30, 2000.

(51) Int. Cl.[7] ..... F03H 5/00; H05B 3/00
(52) U.S. Cl. ..... 60/202; 60/203.1
(58) Field of Search ..... 60/202, 203.1; 313/359.1, 362.1, 361.1; 315/111.01, 111.21, 111.31

(56) References Cited

U.S. PATENT DOCUMENTS

| | | | | | |
|---|---|---|---|---|---|
| 2,763,125 | A | * | 9/1956 | Kadosh et al. | 60/230 |
| 3,041,824 | A | * | 7/1962 | Berhman | 60/203.1 |
| 3,138,919 | A | * | 6/1964 | Deutsch | 60/202 |
| 3,143,851 | A | * | 8/1964 | Nyman | 60/202 |
| 3,367,114 | A | * | 2/1968 | Webb | 60/202 |
| 3,452,225 | A | * | 6/1969 | Gourdine | 310/11 |
| 3,535,586 | A | * | 10/1970 | Sabol | 60/202 |
| 3,678,306 | A | * | 7/1972 | Garnier et al. | 60/202 |
| 4,335,465 | A | * | 6/1982 | Christiansen et al. | 60/203.1 |
| 4,893,470 | A | * | 1/1990 | Chang | 60/202 |

* cited by examiner

*Primary Examiner*—Ted Kim

(57) ABSTRACT

An electric thruster and thrust augmenter is disclosed in which intaken or compressed atmospheric gas or reaction thruster exhaust is passed through a gap space between electrodes so that the atmospheric or reaction thrust exhaust gases are subjected to an electric current of sufficient intensity to rapidly heat and expand such gasses through an exhaust nozzle to produce reaction thrust.

20 Claims, 2 Drawing Sheets

ELECTRIC THRUSTER AND THRUST AUGMENTER

CROSS-REFERENCE TO RELATED APPLICATIONS

This is a continuation-in-part of application Ser. No. 09/676,638 Filed Sep. 30, 2000.

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

This is a continuation-in-part of application Ser. No. 09/676,638 Filed Sep. 30, 2000.

The present invention is a reaction thrusting power plant, which requires a source of electric power such as can be provided with beamed microwave energy, and which may be configured as a ramjet, turbojet engine, or as thrust augmenter for other types of reaction thrusters.

The types of propulsion systems which create a propulsion force known as thrust to propel vehicles at high altitudes are the rocket motor and the jet engine. The propulsion force is the reaction force arising from increasing the backward momentum of a mass ejected rearward by the action of the propulsion system. In the case of the rocket motor, the rearward ejected mass comes from the propellant chemicals carried with the vehicle, and the backward momentum results from the increased rearward velocity of the products of an exothermic reaction between those propellant chemicals. In the case of the jet engine, addition of heat energy to a controlled flow of air passing through the jet engine increases the backward momentum of the airflow.

The typical well known turbo-jet engine includes a multistage axial compressor joined to a turbine having one or more stages for driving the compressor through an axial drive shaft. Between the compressor and the turbine, fuel is mixed with the compressed air from the compressor in a combustion chamber and then ignited for generating hot exhaust gas which is channeled through the turbine, thereby driving the turbine. The remaining momentum of the exhaust gases provides the impulse for jet propulsion. In a ramjet engine the necessity for a turbine driven compressor is eliminated by an air intake which compresses air by the movement of the engine through the atmosphere. The ramjet may also include shutter vanes which prevent burning gases in the combustion chamber from escaping in the forward direction of the engine through the atmosphere.

A jet engine may also typically include a thrust augmenter known as an afterburner which is downstream from the combustion chamber and which injects fuel into the exhaust gas for additional combustion to increase engine thrust before final discharge from the engine. Such thrust increase occurs partially as a result of the increase in the mass of gas exhausted, and partially due to the additional velocity imparted to the exhaust gas by the additional combustion.

Some of the features of the present invention disclosed here as the "electric thruster and thrust augmenter", which may be referred to hereinafter simply as the "electric thruster", relate to features of jet engines and afterburners, but with electric power as the source of energy for heating and imparting momentum to the exhaust gases. Unlike conventional jet engines which burn chemical fuel with gases taken in by the turbine compressor, the electric thruster uses an electrode chamber to rapidly heat compressed atmospheric gases in order to energize them sufficiently to produce thrust. The electrode chamber of the electric thruster includes an arrangement of electrodes which direct an electric current through the compressed gases of sufficient intensity achieve such rapid heating.

The use of electric power to create reaction thrust is well known from ion thrusters, which accelerate ionized matter to high velocities to produce thrust with minimum mass burden, from magnetohydrodynamic devices which accelerate ionized gases with magnetic fields directly, as in the case of U.S. Pat. No. 3,535,586 by Sabol, or indirectly, as in the case of U.S. Pat. No. 3,138,919 by Deutsch, which uses a magnetic field to heat the ionized gas by the magnetic compression method known as the magnetic bottle. Although magnetic field producing devices may be used as final stages for exhaust acceleration in conjunction with the present invention, magnetohydrodynamic effects are not employed to heat or otherwise increase the velocity of the compressed gases within the electrode chamber, and it is only within the electrode chamber that heat energy is imparted to the compressed gases. The use of electric power is also known from the arcjet, which energizes a propellant to sufficient velocity to produce thrust, as disclosed in U.S. Pat. Nos. 4,995,231, 4,926,632, 4,907,407, 4,882,465, 4,866,929, 4,805,400, and 4,800,716. The reaction thrusters disclosed in the arcjet patents, however, use a stored propellant supplied to an arc chamber for heating, and do not use gases compressed within or by a reaction thruster, particularly atmospheric gases. It is also to be noted that in both of the magnetohydrodynamic devices mentioned the means for ionizing the gas to be accelerated is an electric arc, which merely requires sufficient voltage to induce a minimal current flow without substantially heating the gas. Thus, such a current flow which serves only to ionize a gas should be distinguished from the intense current flow necessary to rapidly heat compressed atmospheric gases to produce thrust without acceleration by magnets or by magnetohydrodynamic effects.

The present invention has elements that are covered generally by class 60, power plants, particularly subclasses 203 and 204.

BRIEF SUMMARY OF THE INVENTION

This is a continuation-in-part of application Ser. No. 09/676,638 Filed Sep. 30, 2000.

The present invention is a reaction thrusting power plant, also referred herein as a reaction thruster, which uses intense electric current to heat compressed or previously energized gases, such as compressed atmospheric gases, and exhausts such gasses in order to create thrust. The present invention requires a source of electric power, such as can be provided with beamed microwave energy. Elements of the an electric thruster disclosed herein may also be configured with most other types of reaction thrusters to add velocity to thrusting exhaust as a thrust augmenter, serving a purpose similar to that of an afterburner.

The operation of the electric thruster involves the intake of gases drawn from the atmosphere by an axial compressor or forced in by the forward motion of the electric thruster through the atmosphere, or gases which have been exhausted by another reaction thruster. With compression by a turbine compressor or significant forward motion of the thruster, atmospheric gases may be sent to an electrode chamber where the gases may be rapidly heated by a sufficiently intense electric current conducted between one or more pairs of electrodes with sufficient electrostatic potential. The heated gases are then allowed to expand within an appropriate exhaust nozzle to produce thrust. Such heating and expansion results in a greater velocity of the exhausted gases. Before being exhausted to provide reaction thrust, the heated atmospheric gases from the electrode chamber may flow through and power an axial turbine. The highly ionized gases of the exhaust may in turn be further accelerated by an ion acceleration thrust augmenter, which accelerates the positively charged ions in the exhaust with negatively charged grids or radio-frequency waves to increase the average velocity of the thrust producing exhaust.

Another embodiment of the invention as a thrust augmenter may be used in tandem with any type of reaction thruster which exhausts gases the velocity of which may be increased by heating by an electric current conducted through the gases. In such a thrust augmenter the energetic exhaust gases are sent to an electrode chamber where they may be further heated by electric current between one or more pairs of electrodes and further expanded, thereby increasing the velocity of the gases and increasing thrust.

DETAILED DESCRIPTION OF THE INVENTION

This is a continuation-in-part of application Ser. No. 09/676,638 Filed Sep. 30, 2000.

The present invention is a reaction thrusting power plant which uses a sufficiently intense electric current to heat compressed or previously energized gases, and expands and exhausts such gases in order to create thrust. Thus, the "electric thruster" relates to features of jet engines and afterburners, but with electric power as the source of energy for heating and expanding and thereby imparting momentum to the exhaust gases. Unlike conventional jet engines which burn chemical fuel with gases taken into an air duct for compression, the electric thruster uses a sufficiently intense electric current between one or more pairs of electrodes in an electrode chamber to rapidly heat the compressed gases in order to energize them sufficiently to produce thrust upon being expanded within an appropriate exhaust nozzle. The intensity of the electric current, usually measured in amperes, may be regulated by altering the potential difference between the electrodes, usually measured in volts. Thus, the greater the potential difference between the electrodes (voltage), the greater will be the intensity of the electric current (amperage) conducted between them and through the gas to be heated, for a given state of the gas in terms of temperature and density, and the greater will be the amount of heat energy imparted to the gas. Therefore, the present invention requires a source of electric power, preferably provided by beamed microwave energy. The compression of atmospheric gases may occur as a result of compression by a turbine compressor, or "turbo-compression", as in a turbojet engine; or as a result of intaking atmospheric gases under pressure as a result of the forward motion of the electric thruster, as in a ramjet; or as a result of both forward motion of the electric thruster and turbo-compression. Elements of such an electric thruster as disclosed herein may also be configured with most other types of reaction thrusters to add velocity to their thrusting exhaust as a thrust augmenter. Furthermore, because of the high temperatures generated, the gases heated by the electric current between the electrodes are partially ionized, and additional acceleration of the overall mass of the exhaust gases may be achieved with an ion accelerator, such as those used in ion thrusters, or by magnetohydrodynamic effects created with magnetic fields. Such ion acceleration may also be used in the form of a thrust augmenter for any other reaction thruster exhausts in which significant ionization is present.

Figure 1:
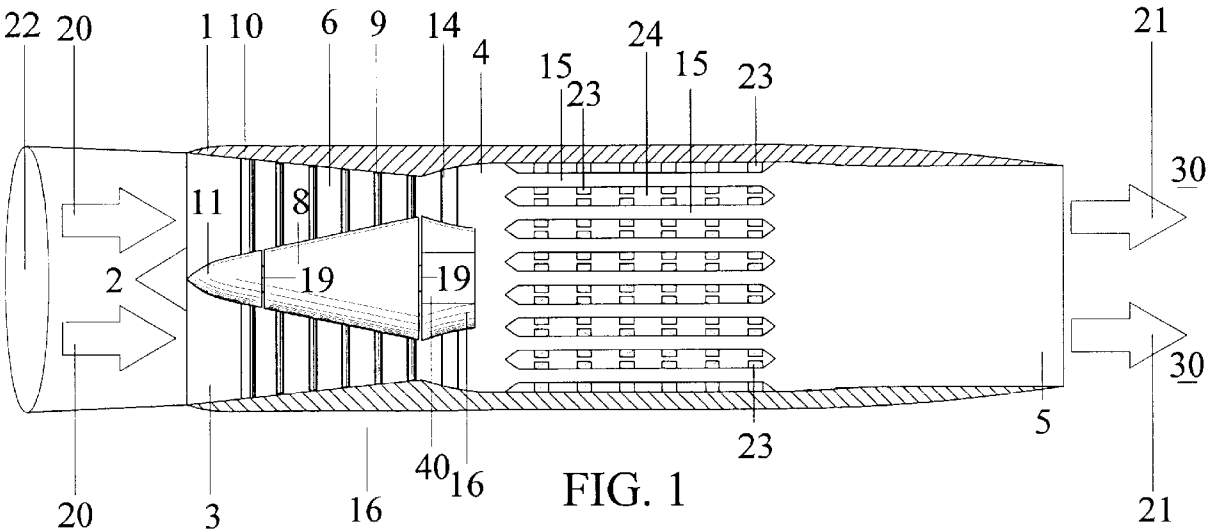
FIG. 1 is a longitudinal sectional view illustrating an electric thruster according to the preferred embodiment of the invention with the compressor driven by an axially located electric motor.
Figure 2:
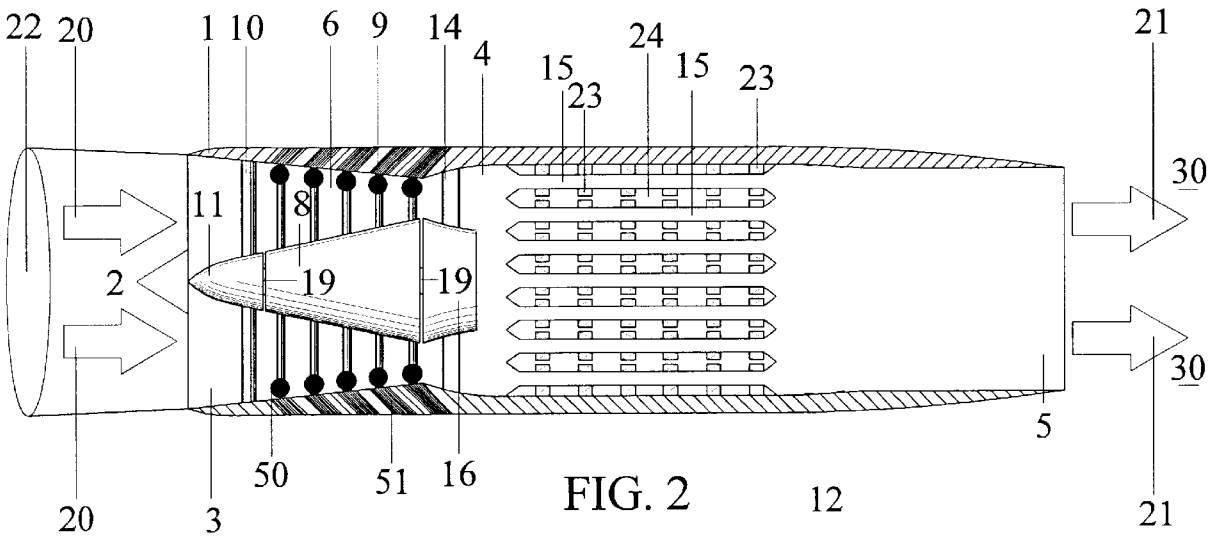
FIG. 2 is a longitudinal sectional view illustrating an electric thruster according to the preferred embodiment of the invention with the compressor driven by an electric motor whose stator is an annular array of magnets about the air duct, and whose armature is the compressor shaft and blades.

The preferred embodiment of the electric thruster is illustrated in FIG. 1 and includes a duct casing 1 which defines a gas duct 2, which in turn defines a gas intake 3, an electrode chamber 4, and an exhaust nozzle 5, and surrounds an axial compressor stage 6. The axial compressor stage 6 has at least one compressor rotor 8 having a plurality of compressor blades 9 extending radially therefrom. The compressor rotor 8 of the axial compressor 8 and 9 is located downstream of first stator guide vane 10 which supports a first hub 11 coaxially with the longitudinal axis of the gas duct 2 to rotatably support the compressor rotor 8. The second stator guide vane 14 supports a second hub 16 coaxialy with the longitudinal axis of the gas duct 2 to also rotatably support the compressor rotor 8 with the first hub 11. The axial compressor 8 and 9 may be driven via a shaft 19 by an axially located electric motor shown schematically as 40, or as in the similarly preferred embodiment shown in FIG. 2, by an annular electric motor shown schematically as 50 and 51 in which the compressor rotor 8 and blades 9 with inductors 50 on the tips serve as the armature which is rotated by stator elements 51 located annularly about the gas duct 2.

Figure 3:
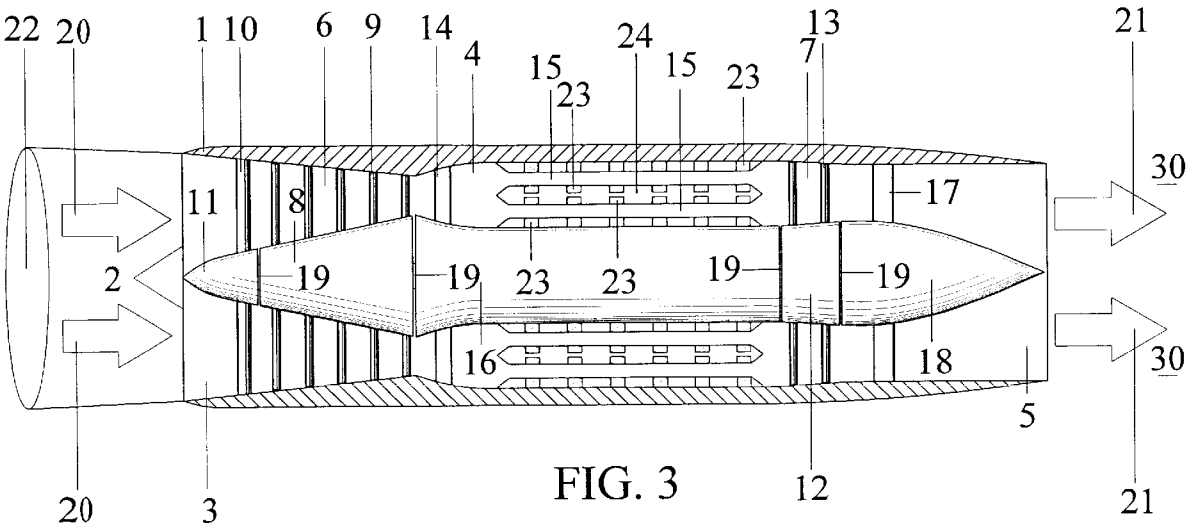
FIG. 3 is a longitudinal sectional view illustrating an electric thruster whose compressor is driven by an axial turbine.

The alternate embodiment shown in FIG. 3 includes an axial turbine stage 7 to drive, via a shaft, the axial compressor 8 and 9 by an axially turbine 12 and 13, which includes at least one turbine rotor 12 with a plurality of turbine blades 13 extending radially therefrom. The axial turbine 12 and 13 is driven by the gases heated by the electric current in the gap space 15 between one or more pairs of electrodes 23 on the electrode bases 24 within the electrode chamber, which then pass across the turbine blades 13. The second stator guide vane 14 supports a second hub 16 coaxially with the longitudinal axis of the gas duct 2 to also rotatably support the compressor rotor 8 with the first hub 11. The turbine rotor 12 of the axial turbine 12 and 13 is located upstream of a third stator guide vane 17, which supports a third hub 18 coaxially with the longitudinal axis of the gas duct 2 to also rotatably support, together with the second hub 16, the turbine rotor 12.

The operation of the electric thruster commences with the intake of gases drawn from the atmosphere 20 by the axial compressor 8 and 9. With compression by the compressor 8 and 9 the atmospheric gases are sent to an electrode chamber 4 to be channeled into gap spaces 15 between one or more pairs of electrodes 23, each pair supporting an electric current across a gap space 15 of sufficient intensity to rapidly heat and expand the atmospheric gases. The one or more pair of electrodes 23 may be in a linear arrangement along the electrode bases 24 within the electrode chamber, which are parallel to the axis of the gas duct 2, so that the gases flowing through the gap spaces 15 may be heated by electric current from more than one pair of electrodes 23 sequentially, resulting in higher temperatures and velocity of the gases. This method of regulation is in addition to regulation of electrode pair potential. In this manner the extent of heating by electric current to which the compressed gasses are subjected may be regulated by increasing or decreasing the number of pairs of electrodes which are conducting, or increasing or decreasing electrode pair potential. The energetic products of the heating of the compressed atmospheric gases by electric current then expanded in the exhaust nozzle and exit from the exhaust nozzle 5 to the space outside 30 the gas duct 2 to provide reaction thrust.

In the alternate embodiment shown in FIG. 3, the energetic products of the heating of the gases by the electric current flow through and power the axial turbine 12 and 13, which is connected to and powers the axial compressor 8 and 9 via a shaft 19 and/or transmission. The energetic exhaust gasses 21 then exit from the exhaust nozzle 5 to the space outside 30 the gas duct 2 to provide reaction thrust.

Atmospheric gases may be supplied to the turbine compressor 8 and 9 directly by intake from the atmosphere or from an atmospheric gas reservoir by at least one gas duct 22. The process of supplying atmospheric gases to the electric thruster may be assisted by electromagnetically accelerating the atmospheric gases to the intake, pumping, including ultrasonic pumping, pre-compression, and/or contraction of the atmospheric gas reservoir. Atmospheric gases may also be supplied directly to the electrode chamber when they are sufficiently compressed by the forward motion of the electric thruster through the atmosphere, without pre-compression by a turbine compressor, which is the case in the "ramjet" embodiment of the invention (not shown in the figures, as it can be easily visualized from FIG. 3 with the elimination of the compressor and turbine components). The ramjet embodiment may also include shutter vanes which prevent gases heated in the electrode chamber from escaping in the forward direction of the thruster.

Figure 4:
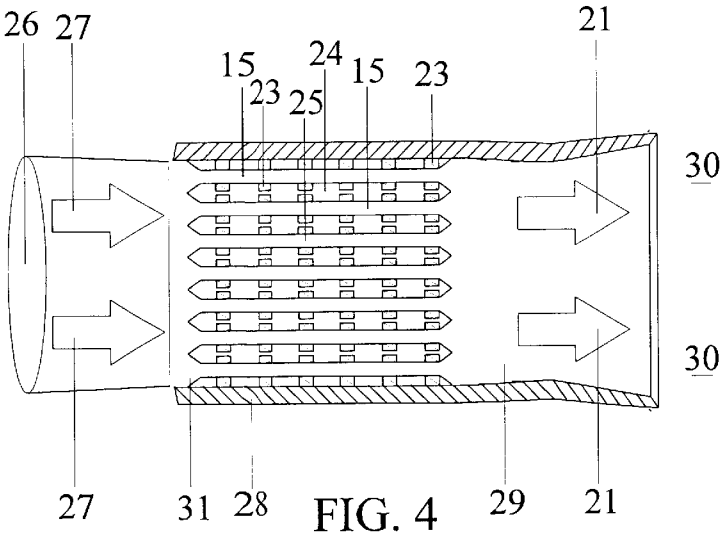
FIG. 4 is a longitudinal sectional view illustrating an electric arc thrust augmenter according to the invention.

Another embodiment of the invention, shown in FIG. 4, is a thrust augmenter stage which may be used in tandem with any type of reaction thruster which exhausts gases, the velocity of which may be increased by the passage of an electric current of sufficient intensity through the gases. The casing 28 is joined with the last stage of the reaction thruster to be augmented, and forms the electrode chamber 31, containing the electrodes 23 arranged in pairs on electrode bases 24 across gap spaces 15, and the exhaust nozzle 29. As in the case of the electric thruster the gases exhausted 27 by the energizing process of the reaction thruster 26 to be augmented are channeled into gap spaces 15 between pairs of electrodes 23, each pair supporting an electric current across a gap space of sufficient intensity to rapidly heat and expand the previously energized gases 27. As with the electric thruster the pairs of electrodes 23 may be in a linear sequence along the electrode bases, so that the gases flowing through the gap spaces 15 may be heated by an electric current conducted between one or more pairs of electrodes 23 sequentially, resulting in a greater velocity of the gases. The energetic exhaust gasses 21 then exit from the exhaust nozzle 29 to the space outside the gas duct 30 to provide reaction thrust.

Figure 5:
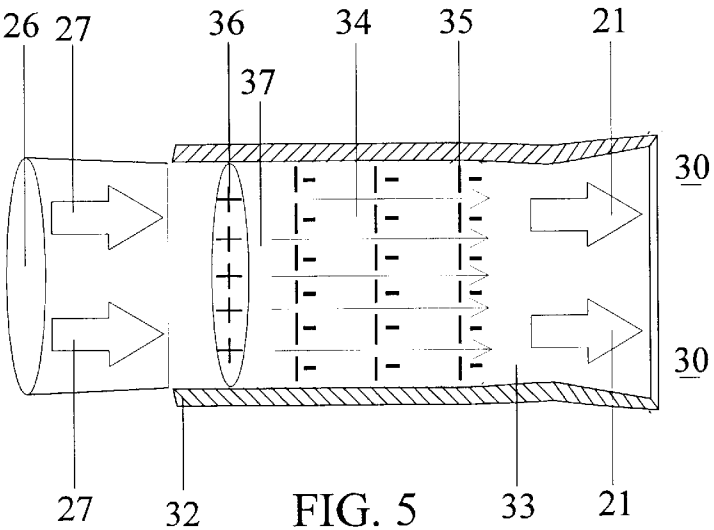
FIG. 5 is a longitudinal sectional view illustrating an ion accelerator thrust augmenter according to the invention.

Other embodiments of the invention include an ion accelerator thrust augmenter, shown in FIG. 5, which may be used as a final stage of the electric thruster or in tandem with other types of reaction thrusters, such as the turbo-rocket thruster disclosed in U.S. patent application Ser. No. 09/321,796 to further increase the velocity of exhaust gases for increase of thrust. The ion accelerator thrust augmenter operates in the nature of the well known ion thruster, which accelerates an ionized gas produced by an ionization chamber. The ion accelerator thrust augmenter, however, accelerates the positively charged ions in a moving heated gas that is the exhaust of another reaction thruster, instead of accelerating an ionized gas from an ionization chamber. The casing 32 is joined with the last stage of the reaction thruster 26 to be augmented, and defines the ion acceleration chamber 34, containing negatively charged grids 35, and the exhaust nozzle 33. The positively charged ions 36 in the exhaust 27 of a reaction thruster 26 are accelerated by negatively charged grids 35 or radio-frequency waves through the ion acceleration chamber 34, which increases the velocity of the thrust producing exhaust 21 to the space outside the gas duct 37 to provide augmented reaction thrust. The negatively charged grids 35 may be arranged to have successively greater negative charge, i.e. greater negative potential or voltage, from one grid to the next from the intake end to the exhaust end of the thrust augmenter, to enhance the acceleration of the positively charge ions.

While the invention has been disclosed in a particular embodiment, it will be understood that there is no intention to limit the invention to the particular embodiment shown, but it is intended to cover the various alternative and equivalent constructions included within the spirit and scope of the appended claims.

What i claim as my invention is:

1. An electric thruster comprising:

(a) a gas duct defining an atmospheric gas intake, (b) a source of atmospheric gas;

(c) an electrode chamber further comprising one or more pairs of electrodes mounted so that said one or more pairs of electrodes are separated by a gap space through which an electric current is directed between the electrodes of each of said one or more pairs of electrodes; and so that said electric current is generally perpendicular with and across the atmospheric gas flow through the gap space, and is of sufficient intensity to rapidly heat and thereby increase the velocity of the atmospheric gas which is passing through the electrode chamber without subjecting the atmospheric gas flow to acceleration by magnetic effects;

(d) a source of electric power;

(e) a compressor for compressing atmospheric gas; and (f) a nozzle operatively associated with the gas duct to exhaust gasses from the gas duct to produce thrust.

2. The electric thruster of claim 1, further comprising: a turbine operatively associated with the compressor to drive the compressor, the turbine being disposed axially within the gas duct, wherein the turbine is driven by the atmospheric gas which has passed through the electrode chamber.

3. The electric thruster of claim 1, wherein the source of atmospheric gases is a reservoir of such atmospheric gases.

4. The electric thruster of claim 1, wherein the source of atmospheric gases is the atmosphere.

5. The electric thruster of claim 1, wherein the compressor is an axial compressor for compressing atmospheric gases, the axial compressor comprising at least one compressor rotor, each compressor rotor having a plurality of compressor blades extending radially therefrom and disposed within the gas duct.

6. The electric thruster of claim 5, wherein the compressor is driven by an axially located electric motor.

7. The electric thruster of claim 5, wherein compressor is driven by an annularly located electric motor comprising:

(a) a plurality of inductors, each of which is incorporated in the radial end of one of the blades of the compressor rotor; and (b) a plurality stator elements located annularly about the gas duct.

8. The electric thruster of claim 1, wherein pairs of electrodes are in a linear arrangement parallel to the axis of the gas duct so that the atmospheric gas flowing through the gap spaces is heated by an electric current between each of said pairs of electrodes.

9. The electric thruster of claim 1, wherein the amount of electric current to which the atmospheric gas is subjected is regulated by increasing or decreasing the number of pairs of electrodes conducting electric current.

10. The electric thruster of claim 1, wherein an increase in the number of said one or more pairs of electrodes conducting electric current will increase the thrust of the electric thruster.

11. The electric thruster of claim 1, wherein an increase in the potential between said one or more pairs of electrodes will increase the electric current flowing between said electrodes, thereby increasing the thrust of the electric thruster.

12. The electric thruster of claim 1, wherein the exhausted gases are further accelerated by an ion accelerator.

13. An electric thruster comprising:

(a) a gas duct;

(b) a source of atmospheric gas;

(c) an electrode chamber further comprising one or more pairs of electrodes mounted so that said one or more pairs of electrodes are separated by a gap space through which an electric current is directed between the electrodes of each of said one or more pairs of electrodes; and so that said electric current is generally perpendicular with and across the atmospheric gas flow through the gap space, and is of sufficient intensity to rapidly heat and thereby increase the velocity of the atmospheric gas which is passing through the electrode chamber without subjecting the atmospheric gas flow to acceleration by magnetic effects;

(d) a source of electric power;

(e) a nozzle operatively associated with the gas duct to exhaust atmospheric gas from the gas duct to produce thrust;

(f) a compressor for compressing atmospheric gas; and (g) an electric motor for driving the compressor.

14. The electric thruster of claim 13, wherein the electric motor for driving the compressor comprises:

(a) inductors on the radial ends of one or more of the blades of the compressor rotor; and (b) stator elements located annularly about the gas duct.

15. The electric thruster of claim 13, wherein pairs of electrodes are in a linear arrangement parallel to the axis of the gas duct so that the atmospheric gas flowing through the gap spaces is heated by an electric current between each of said pairs of electrodes.

16. The electric thruster of claim 13, wherein an increase in the number of said one or more pairs of electrodes conducting electric current will increase the thrust of the electric thruster.

17. The electric thruster of claim 13, wherein an increase in the potential between said one or more pairs of electrodes will increase the electric current flowing between said electrodes, thereby increasing the thrust of the electric thruster.

18. The electric thruster of claim 13, wherein a decrease in the number of said one or more electrode pairs arcing will decrease the thrust of the electric thruster.

19. The electric thruster of claim 13, wherein the exhausted atmospheric gas is further accelerated by an ion accelerator.

20. An electric thruster comprising:

(a) a gas duct defining an atmospheric gas intake;

(b) a source of atmospheric gas;

(c) an electrode chamber further comprising one or more pairs of electrodes mounted so that said one or more pairs of electrodes are separated by a gap space through which an electric current is directed between the electrodes of each of said one or more pairs of electrodes; and so that said electric current is generally perpendicular with and across the atmospheric gas flow through the gap space, and is of sufficient intensity to rapidly heat and thereby increase the velocity of the atmospheric gas which is passing through the electrode chamber without subjecting the atmospheric gas flow to acceleration by magnetic effects;

(d) a source of electric power;

(e) a compressor for compressing atmospheric gas;

(f) an ion acceleration chamber operatively associated with the gas duct for receiving atmospheric gas which has passed through the electric arc chamber;

(g) an ion accelerator disposed in said ion acceleration chamber; and (h) a nozzle operatively associated with the gas duct to exhaust gas from the gas duct to produce thrust.

* * * * *